US010974940B1

(12) United States Patent
Siegenthaler et al.

(10) Patent No.: US 10,974,940 B1
(45) Date of Patent: Apr. 13, 2021

(54) MANHOLE ADJUSTMENT RING REMOVAL ASSEMBLY AND METHOD

(71) Applicants: Anthony Siegenthaler, Rochester, MN (US); Chad Emmons, Rochester, MN (US)

(72) Inventors: Anthony Siegenthaler, Rochester, MN (US); Chad Emmons, Rochester, MN (US)

( * ) Notice: Subject to any disclaimer, the term of this patent is extended or adjusted under 35 U.S.C. 154(b) by 15 days.

(21) Appl. No.: 16/669,671

(22) Filed: Oct. 31, 2019

(51) Int. Cl.
*B66F 19/00* (2006.01)
*E02D 29/14* (2006.01)
*B66C 1/28* (2006.01)

(52) U.S. Cl.
CPC ..... *B66F 19/005* (2013.01); *E02D 29/1445* (2013.01); *B66C 1/28* (2013.01); *E02D 29/1418* (2013.01)

(58) Field of Classification Search
CPC ..... B66F 19/005; E02D 29/1445; E02D 29/1418; E02D 29/14; E02D 29/1409; B66C 1/28
USPC ..... 294/81.21, 81.61
See application file for complete search history.

(56) References Cited

U.S. PATENT DOCUMENTS 1,477,687 A * 12/1923 Brown ..... B21C 47/30 242/362.3
2,370,482 A * 2/1945 Morgan ..... B66C 1/54 294/97
3,033,605 A * 5/1962 Morrow, Jr. ..... B66C 1/54 294/97
3,211,490 A * 10/1965 Gardner ..... B66C 1/54 294/194
3,251,623 A * 5/1966 Gunnar ..... B66C 1/54 294/97
3,544,151 A * 12/1970 Stokes ..... B66C 1/447 294/119.2
4,460,210 A * 7/1984 Miechur ..... B66C 1/54 294/97
5,263,796 A 11/1993 de Waal
5,306,062 A 4/1994 Dodge
5,382,131 A 1/1995 Werthmann
5,476,300 A 12/1995 Dodge
5,947,633 A 9/1999 Foss
6,609,742 B1 8/2003 Macom
7,278,671 B1 10/2007 Herford
7,387,463 B2 6/2008 Winn, Jr.
7,740,415 B1 6/2010 Crites
8,591,138 B2 11/2013 Royer
8,646,847 B2 2/2014 Cochran
(Continued)

*Primary Examiner* — Stephen A Vu

(57) ABSTRACT

A manhole adjustment ring removal assembly includes a frame. A pair of legs is pivotally coupled to the frame. Each of the legs has an upper end and a lower end and each end has one of a pair of the plates attached thereto. The plates each have an outer edge extending outwardly away from a corresponding one of the legs. The outer edges taper to point and are extendable between an adjustment ring and a cone base. A drive assembly is mounted on the frame and is mechanically coupled to the legs. The drive assembly is actuated in a first direction moving the lower ends away from each other and in a second direction moving the lower ends toward each other. A lift ring is attached to the frame to be engaged with a cable to lift the frame when the plates are positioned under the adjustment ring.

6 Claims, 6 Drawing Sheets

(56) References Cited

U.S. PATENT DOCUMENTS

| | | | |
|---|---|---|---|
| 8,764,083 | B2 | 7/2014 | Belder |
| 2010/0117389 | A1 | 5/2010 | Poole |

* cited by examiner

MANHOLE ADJUSTMENT RING REMOVAL ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

Devices to assist a person in removing an adjustment ring from a manhole aperture.

(2) Description of Related Art Including Information Disclosed Under 37 CFR 1.97 and 1.98

The prior art relates to devices used to dislodge objects from each other.

BRIEF SUMMARY OF THE INVENTION

An embodiment of the disclosure meets the needs presented above by generally comprising a frame. A pair of legs is pivotally coupled to and extends downwardly from the frame. Each of the legs has an upper end and a lower end and each end has one of a pair of the plates attached thereto. The plates each have an outer edge extending outwardly away from a corresponding one of the legs. The outer edges taper to point and are extendable between an adjustment ring and a cone base. A drive assembly is mounted on the frame and is mechanically coupled to the legs. The drive assembly is actuated in a first direction moving the lower ends away from each other and in a second direction moving the lower ends toward each other. A lift ring is attached to the frame to be engaged with a cable to lift the frame when the plates are positioned under the adjustment ring.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
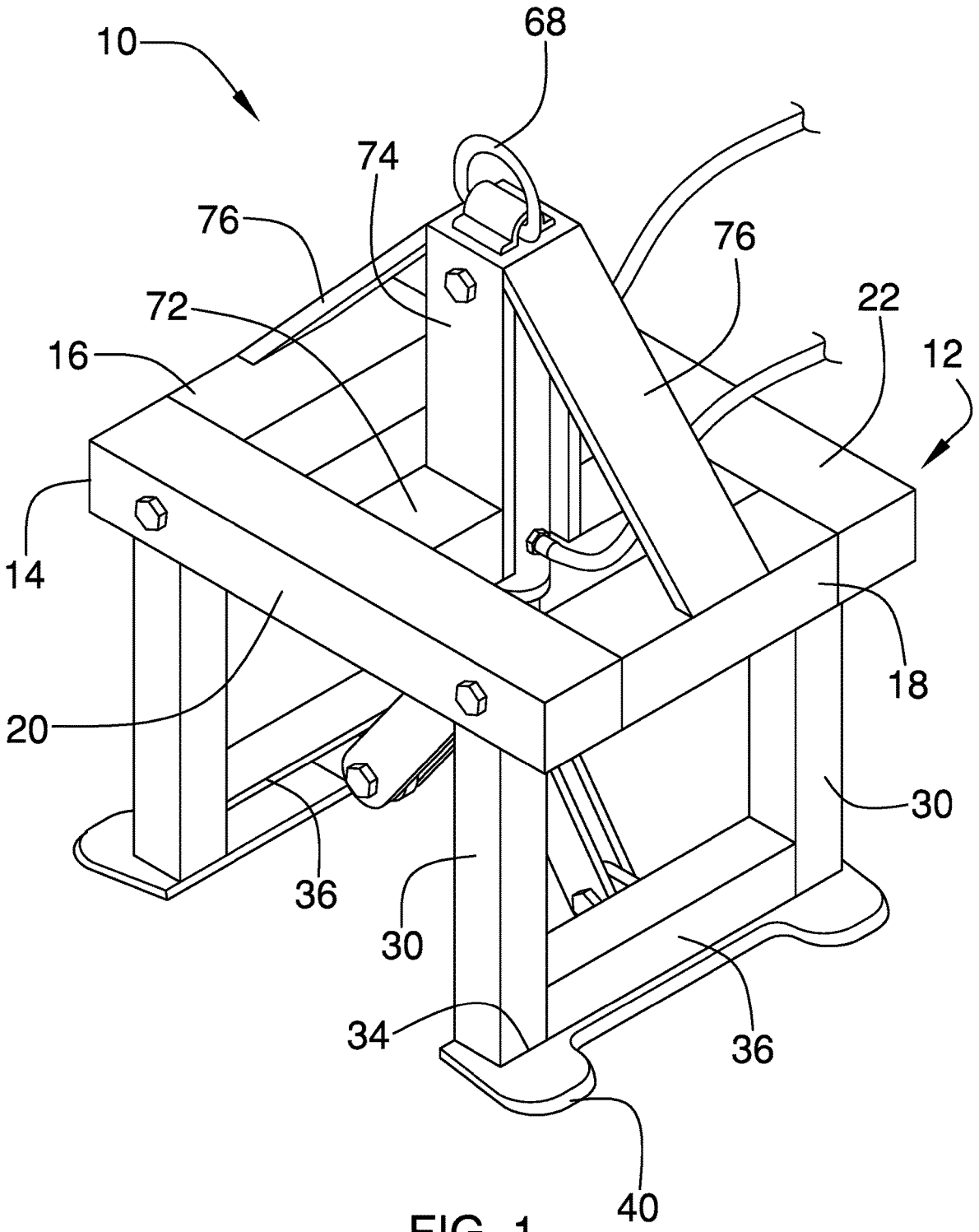
FIG. 1 is a front perspective view of a manhole adjustment ring removal assembly and method according to an embodiment of the disclosure.
Figure 2:
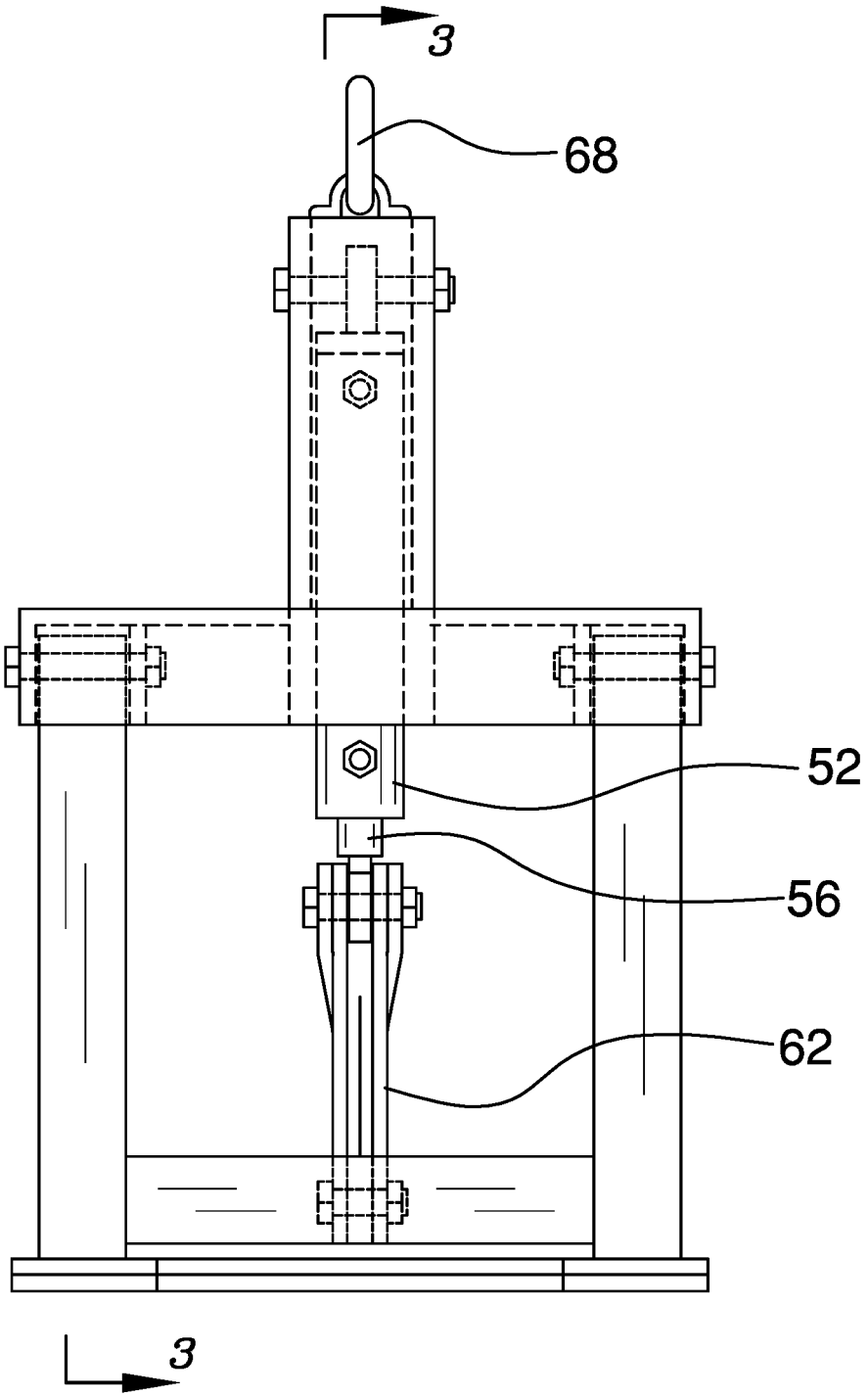
FIG. 2 is a front view of an embodiment of the disclosure.

With reference now to the drawings, and in particular to FIGS. 1 through 6 thereof, a new manhole adjustment ring removal device embodying the principles and concepts of an embodiment of the disclosure and generally designated by the reference numeral 10 will be described.

As best illustrated in FIGS. 1 through 6, the manhole adjustment ring removal assembly and method 10 generally comprises a frame 12, or housing, comprising a perimeter wall 14. The perimeter wall may have a rectangular shape and include a first end member 16, a second end member 18, a first lateral member 20 and a second lateral member 22. The frame 12 will have a length and width each typically between 1.5 feet and 3.0 feet.

Figure 3:
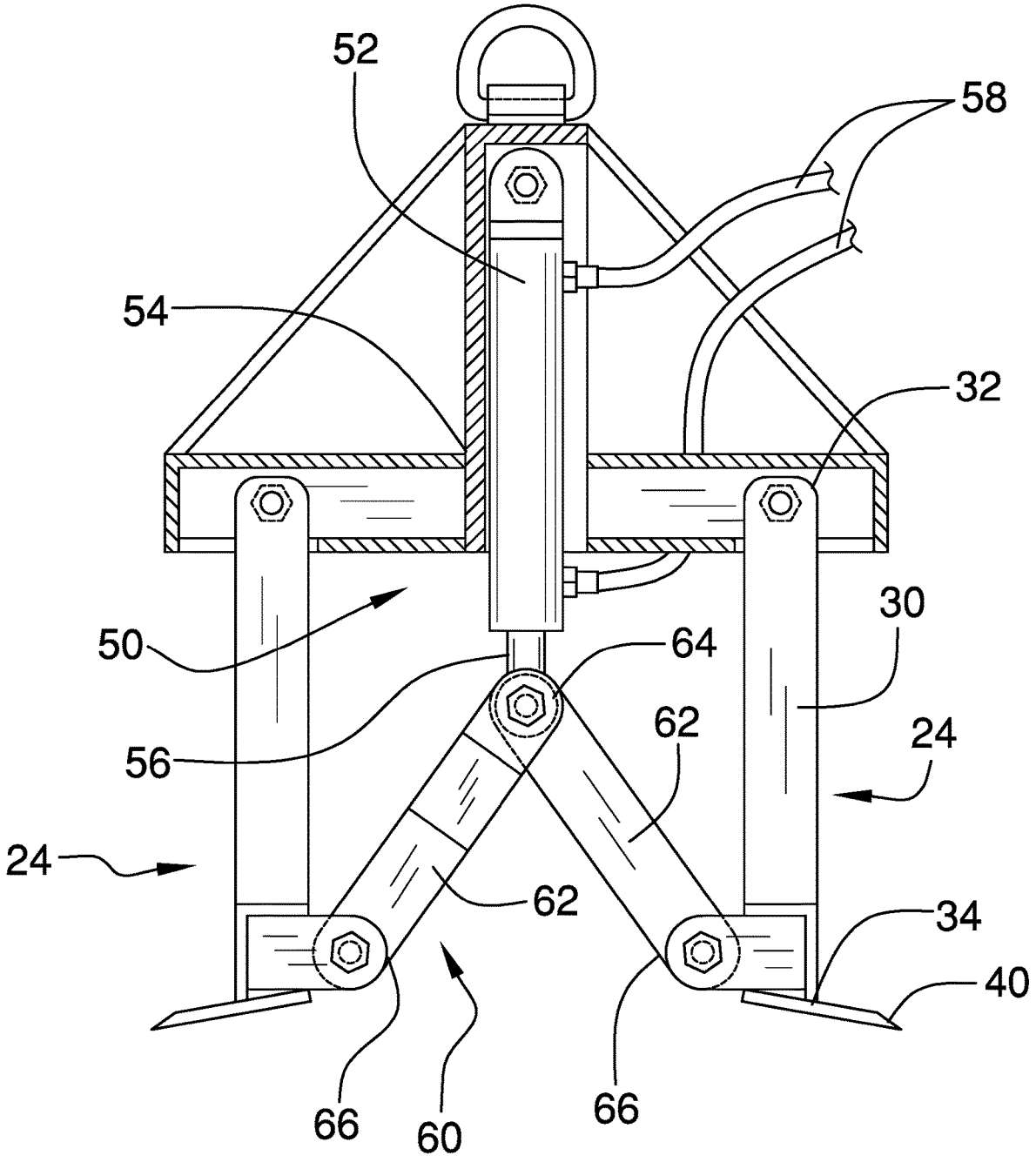
FIG. 3 is a cross-sectional view of an embodiment of the disclosure taken along line 3-3 of FIG. 2.
Figure 4:
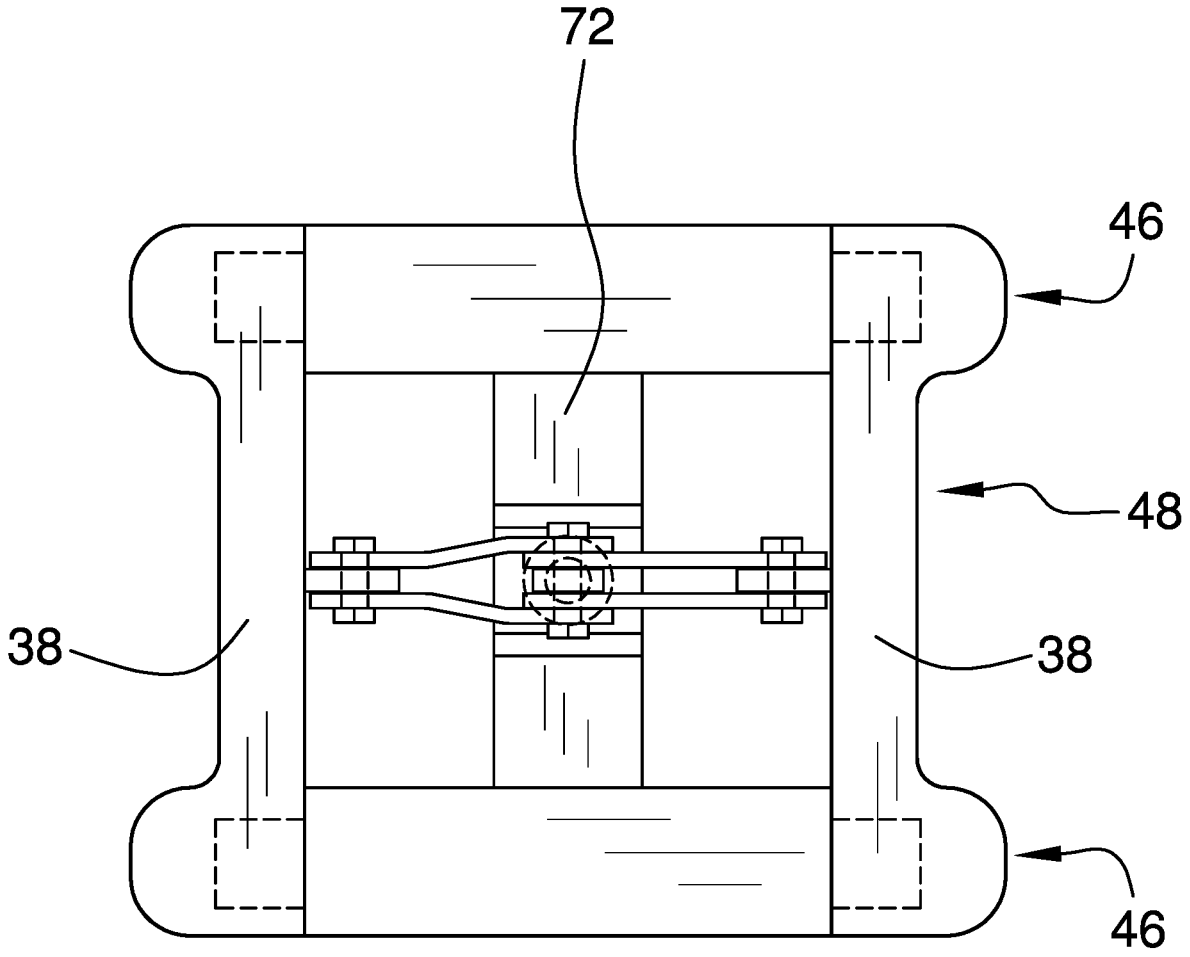
FIG. 4 is a bottom view of an embodiment of the disclosure.
Figure 5:
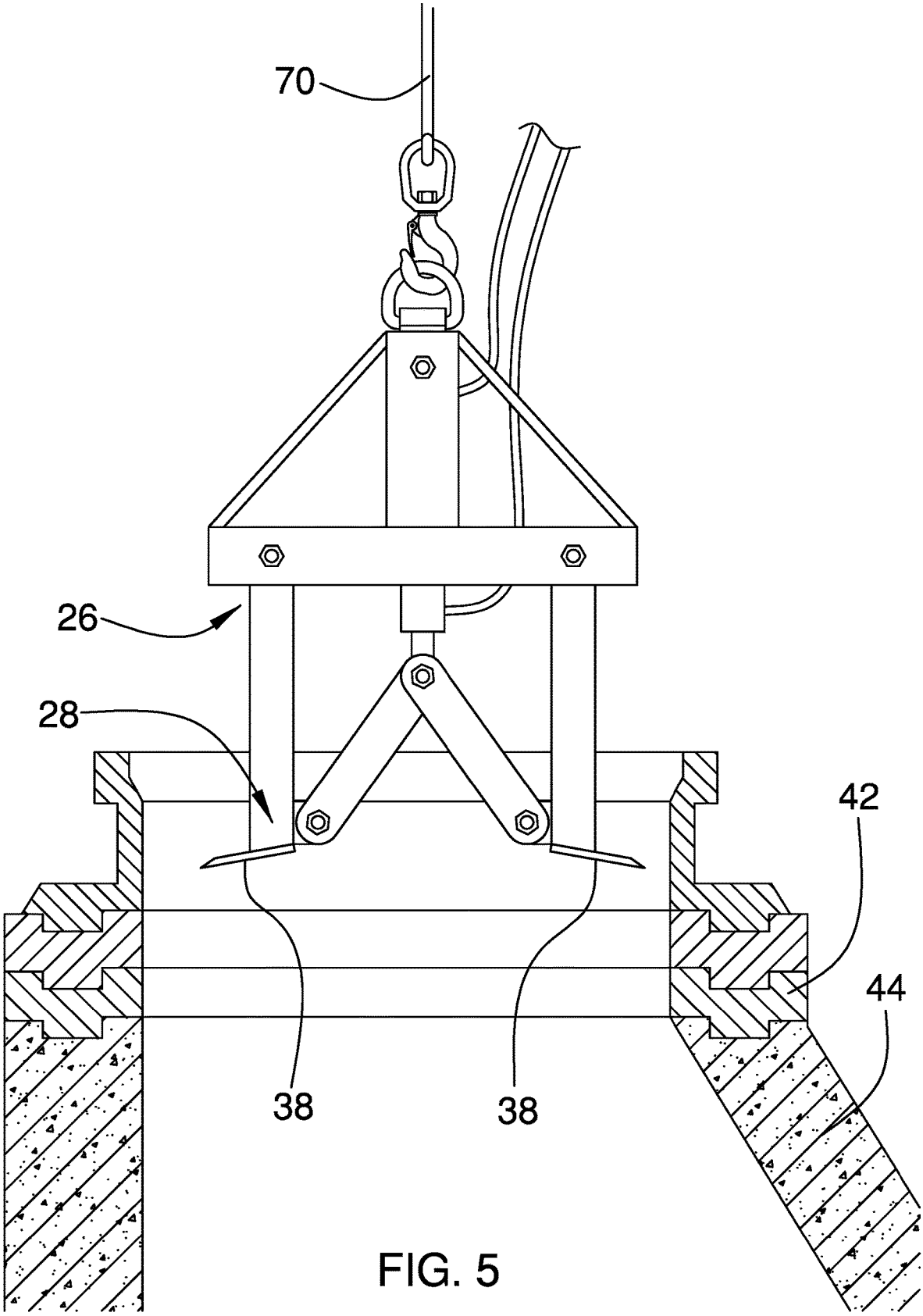
FIG. 5 is a side in-use view of an embodiment of the disclosure.
Figure 6:
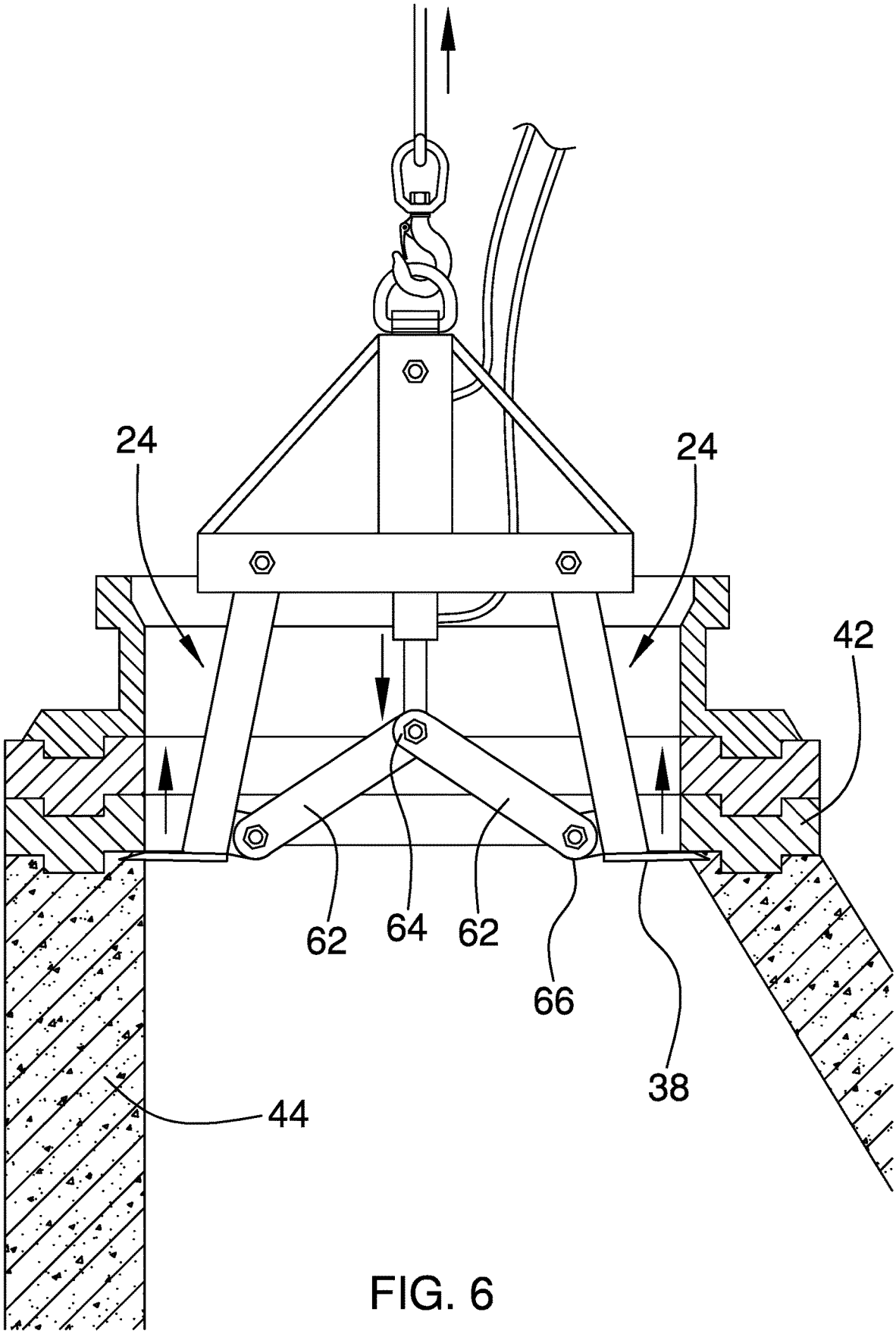
FIG. 6 is a side in-use view of an embodiment of the disclosure.

A pair of legs 24 is pivotally coupled to and extends downwardly from the frame 12. One of the legs 24 is positioned adjacent to the first end member 16 and while the other one of legs 24 is positioned adjacent to the second end member 18. Each of the legs 24 has an upper end 26 and a lower end 28. More specifically each of the legs 24 may include a pair of posts 30 that are vertically orientated and are laterally spaced from each other. The posts 30 each have a proximal end 32 and a distal end 34 relative to the frame 12. The posts 30 are pivotally coupled to the frame 12 as can be seen in FIG. 3. It should be understood that instead of a pair of posts 30, the legs 24 may each comprise one continuous panel or wall extending downwardly from the frame 12. A lower member 36 is attached to and extends between the posts 30. The lower member 36 is positioned adjacent to the distal ends 34 and facilitates rigidity between the attached ones of the posts 30.

A pair of plates 38 is provided. Each of the lower ends 28 of the legs 24 has one of the plates 38 attached thereto. The plates 38 each has an outer edge 40 extending outwardly away from a corresponding one of the legs 24. That is, the plates 38 extend in opposite directions with respect to each other as opposed with extending toward each other. The outer edges 40 taper to point or bladed edge. The outer edges 40 are configured to be extended between an adjustment ring 42 of a manhole cover holder and a cone base 44 on which the adjustment ring 42 is positioned. Each of the outer edges 40 includes a pair of outer sections 46 and an inner positioned 48 between the outer sections 46. The outer sections 46 extend farther outwardly from an associated leg 24 than a corresponding one of the inner sections 48. This shape ensures that the inner section 48 does not first engage the adjustment ring 42 as the adjustment ring 42 has a tubular shape. The outer sections 46 first engage the adjustment ring 42 and the inner section 48 will thereafter engage the adjustment ring 42. As can be seen in FIG. 1, each of the posts 30 is aligned with one of the outer sections 46.

A drive assembly 50 is mounted on the frame 12 and is mechanically coupled to the legs 24. The drive assembly 50 is actuated in a first direction moving the lower ends 28 away from each other and is actuated in a second direction moving the lower ends 28 toward each other. The drive assembly 50 may include a cylinder 52 that is mounted on the frame 12. As is shown in FIG. 3, a support 54 is mounted on the frame 12 from which the cylinder 52 extends. A piston 56 is mounted in the cylinder 52 and is pneumatically or hydraulically moved between an extended position and a retracted position. Air or fluid lines 58 are therefore fluidly coupled to the cylinder 52. Generally, the piston 56 moves downwardly from the frame 12 when it is being extended. A linkage 60 is attached to each of the legs 24 and to the piston 56. The linkage 60 moves the legs 24 away from each other when the piston 56 extends from the cylinder 52. More particularly, the linkage 60 may include a pair of arms 62 each having a first end 64 and a second end 66. The first ends 64 are pivotally coupled together and to the piston 56. Each of the legs 24 has one of the arms 62 attached thereto and, more particularly, the second ends 66 are attached to the lower member 36 of each of the legs 24.

A lift ring 68 is attached to the frame 12. The lift ring 68 is configured to be engaged with a cable 70 to lift the frame 12 when the plates 38 are positioned under the adjustment ring 42. The lift ring 68 may be attached to and extend upwardly from the support 54. The support 54 may include a horizontal member 72 attached to the perimeter wall 14 such that it traverses an area bound by the perimeter wall 14. A vertical member 74 attached to the horizontal member 72 is coupled to the cylinder 52 while buttresses 76 extend from the vertical member 74 to the perimeter wall 14.

In use, the fame 12 is moved downwardly through a manhole cover support until the plates 38 are positioned horizontally level with a juncture of an adjustment ring 42 and the cone base 44. The drive assembly 50 is actuated to bias the plates 38 outwardly such that they pry between the adjustment ring 42 and the cone base 44 to dislodge the adjustment ring 42 from the cone base 44. At this point, the adjustment ring 42 is resting on top of the plates 38. A cable 70, attached to the lift ring 68, is then retracted to lift the frame 12 and engaged adjustment ring 42 upwardly away from the cone base 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A manhole ring removal tool assembly configured to disengage an adjustment ring from a cone base such that the adjustment ring may be lifted upwardly away from the cone base, said assembly comprising:

a frame;

a pair of legs being pivotally coupled to and extending downwardly from said frame, each of said legs having an upper end and a lower end;

a pair of plates, each of said lower ends of said legs having one of said plates attached thereto, said plates each having an outer edge extending outwardly away from a corresponding one of said legs, said outer edges tapering to point, said outer edges being configured to be extended between the adjustment ring and the cone base;

a drive assembly being mounted on said frame, said drive assembly being mechanically coupled to said legs, said drive assembly being actuated in a first direction moving said lower ends away from each other, said drive assembly being actuated in a second direction moving said lower ends toward each other, wherein said drive assembly comprises a cylinder mounted on said frame, a piston being mounted in said cylinder, said cylinder being pneumatically or hydraulically moved between an extended position and a retracted position, and a linkage being attached to each of said legs and to said piston, said linkage moving said legs away from each other when said piston extends from said cylinder; and a lift ring being attached to said frame, said lift ring being configured to be engaged with a cable to lift said frame when said plates are positioned under the adjustment ring.

2. The manhole ring removal tool assembly according to claim 1, wherein said frame comprises a perimeter wall and including a first end member, a second end member, a first lateral member and a second lateral member, one of said legs being positioned adjacent to said first end member and one said legs being positioned adjacent to said second end member.

3. The manhole ring removal tool assembly according to claim 1, said assembly further comprising:

said frame comprising a perimeter wall and including a first end member, a second end member, a first lateral member and a second lateral member;

one of said legs being positioned adjacent to said first end member and one said legs being positioned adjacent to said second end member, each of said legs comprising:

a pair of posts being vertically orientated and being laterally spaced from each other, said posts each having a proximal end and a distal end relative to said frame;

a lower member being attached to and extending between said posts, said lower member being positioned adjacent to said distal ends;

a pair of plates, each of said lower ends of said legs having one of said plates attached thereto, said plates each having an outer edge extending outwardly away from a corresponding one of said legs, said outer edges tapering to point, said outer edges being configured to be extended between the adjustment ring and the cone base, each of said outer edges including a pair of outer sections and an inner positioned between said outer sections, said outer sections extending farther outwardly from an associated leg than a corresponding one of said inner sections;

said drive assembly comprising said linkage being attached to said lower member of each of said legs.

4. A manhole ring removal tool assembly configured to disengage an adjustment ring from a cone base such that the adjustment ring may be lifted upwardly away from the cone base, said assembly comprising:

a frame;

a pair of legs being pivotally coupled to and extending downwardly from said frame, each of said legs having an upper end and a lower end;

a pair of plates, each of said lower ends of said legs having one of said plates attached thereto, said plates each having an outer edge extending outwardly away from a corresponding one of said legs, said outer edges tapering to point, said outer edges being configured to be extended between the adjustment ring and the cone base;

a drive assembly being mounted on said frame, said drive assembly being mechanically coupled to said legs, said drive assembly being actuated in a first direction moving said lower ends away from each other, said drive assembly being actuated in a second direction moving said lower ends toward each other, wherein said drive assembly comprises a cylinder mounted on said frame, a piston being mounted in said cylinder, said cylinder being pneumatically or hydraulically moved between an extended position and a retracted position, and a linkage being attached to each of said legs and to said piston, said linkage moving said legs away from each other when said piston extends from said cylinder;

a lift ring being attached to said frame, said lift ring being configured to be engaged with a cable to lift said frame when said plates are positioned under the adjustment ring;

said frame comprising a perimeter wall and including a first end member, a second end member, a first lateral member and a second lateral member, one of said legs being positioned adjacent to said first end member and one said legs being positioned adjacent to said second end member; and each of said legs comprising a pair of posts being vertically orientated and being laterally spaced from each other, said posts each having a proximal end and a distal end relative to said frame, and a lower member being attached to and extending between said posts, said lower member being positioned adjacent to said distal ends.

5. A manhole ring removal tool assembly configured to disengage an adjustment ring from a cone base such that the adjustment ring may be lifted upwardly away from the cone base, said assembly comprising:

a frame;

a pair of legs being pivotally coupled to and extending downwardly from said frame, each of said legs having an upper end and a lower end;

a pair of plates, each of said lower ends of said legs having one of said plates attached thereto, said plates each having an outer edge extending outwardly away from a corresponding one of said legs, said outer edges tapering to point, said outer edges being configured to be extended between the adjustment ring and the cone base;

a drive assembly being mounted on said frame, said drive assembly being mechanically coupled to said legs, said drive assembly being actuated in a first direction moving said lower ends away from each other, said drive assembly being actuated in a second direction moving said lower ends toward each other;

a lift ring being attached to said frame, said lift ring being configured to be engaged with a cable to lift said frame when said plates are positioned under the adjustment ring; and wherein each of said outer edges includes a pair of outer sections and an inner positioned between said outer sections, said outer sections extending farther outwardly from an associated leg than a corresponding one of said inner sections.

6. The manhole ring removal tool assembly according to claim 3, wherein said drive assembly comprising:

a cylinder mounted on said frame;

a piston being mounted in said cylinder, said cylinder being pneumatically or hydraulically moved between an extended position and a retracted position; and a linkage being attached to each of said legs and to said piston, said linkage moving said legs away from each other when said piston extends from said cylinder, said linkage being attached to said lower member of each of said legs;

a lift ring being attached to said frame, said lift ring being configured to be engaged with a cable to lift said frame when said plates are positioned under the adjustment ring.

* * * * *